US008328021B2

(12) United States Patent
Harju et al.

(10) Patent No.: US 8,328,021 B2
(45) Date of Patent: Dec. 11, 2012

(54) APPARATUS FOR SCREENING FIBROUS SUSPENSIONS

(75) Inventors: Petri Harju, Hamina (FI); Sami Siik, Neuvoton (FI); Simo Kiero, Kotka (FI); Ville Terävä, Kotka (FI)

(73) Assignee: Andritz Oy, Helsinki (FI)

( * ) Notice: Subject to any disclaimer, the term of this patent is extended or adjusted under 35 U.S.C. 154(b) by 420 days.

(21) Appl. No.: 12/238,885

(22) Filed: Sep. 26, 2008

(65) Prior Publication Data

US 2009/0084711 A1 Apr. 2, 2009

(30) Foreign Application Priority Data

Sep. 28, 2007 (FI) ..... 20070741

(51) Int. Cl.
*B07B 1/22* (2006.01)

(52) U.S. Cl. ..... 209/270; 209/240; 209/273; 210/413

(58) Field of Classification Search ..... 209/240, 209/255, 270, 284, 288; 162/55
See application file for complete search history.

(56) References Cited

U.S. PATENT DOCUMENTS

| | | | | | |
|---|---|---|---|---|---|
| 3,174,622 | A | * | 3/1965 | Lamort | 209/273 |
| 3,409,132 | A | * | 11/1968 | Meadows | 209/273 |
| 4,097,374 | A | | 6/1978 | Young | |
| 4,193,865 | A | * | 3/1980 | Aario | 209/240 |
| 4,776,957 | A | * | 10/1988 | Lampenius et al. | 210/413 |
| 4,836,915 | A | * | 6/1989 | Frejborg | 209/273 |
| 4,919,797 | A | * | 4/1990 | Chupka et al. | 209/273 |
| 5,000,842 | A | * | 3/1991 | Ljokkoi | 209/273 |
| 5,147,543 | A | | 9/1992 | Frejborg | |
| 5,172,813 | A | * | 12/1992 | Ljokkoi | 209/270 |
| 5,176,261 | A | | 1/1993 | Holz | |
| 5,192,438 | A | * | 3/1993 | Frejborg | 210/413 |
| 5,224,603 | A | | 7/1993 | Hanana et al. | |
| 5,307,939 | A | | 5/1994 | Young et al. | |
| 5,497,886 | A | | 3/1996 | Young et al. | |
| 5,547,083 | A | * | 8/1996 | Alajaaski et al. | 209/273 |
| 5,587,077 | A | | 12/1996 | Aaltonen et al. | |
| 5,601,192 | A | | 2/1997 | Hutzler et al. | |
| 5,968,315 | A | * | 10/1999 | Meinander | 162/55 |
| 6,193,073 | B1 | | 2/2001 | Chupka et al. | |
| 6,311,850 | B1 | | 11/2001 | Friedrich et al. | |
| 6,588,599 | B2 | * | 7/2003 | Gabl et al. | 209/273 |

FOREIGN PATENT DOCUMENTS

| | | |
|---|---|---|
| CA | 2 186 328 | 3/1997 |
| EP | 1 143 065 | 10/2001 |
| WO | 94/23848 | 10/1994 |
| WO | 02/064884 | 8/2002 |

* cited by examiner

*Primary Examiner* — Terrell Matthews
(74) *Attorney, Agent, or Firm* — Nixon & Vanderhye P.C.

(57) ABSTRACT

An apparatus for screening a fibrous suspension including: a housing, conduits therein at least for fiber suspension being fed, reject and accept, and a rotor and a cylindrical screen drum installed in the housing, at least one of which is rotatable, whereby a surface of the rotor is provided with rotor elements in proximity to the surface of the screen drum, whereby each rotor element includes a front surface facing a flow of the fiber suspension, an upper surface and a trailing surface sloping from the upper surface towards the surface of the rotor, wherein the trailing surface of the rotor element is curved and sidewalls of the trailing surface converge at a back point of the rotor element.

17 Claims, 5 Drawing Sheets

APPARATUS FOR SCREENING FIBROUS SUSPENSIONS

BACKGROUND OF THE INVENTION

The present invention relates to a screen for treating fibrous suspensions, such as pulps, of the wood processing industry. Especially it relates to the construction of a rotor element for the screen.

Pressure screens are essential devices in the production of pulp and paper. They remove from the pulp suspension mainly impurities, over-sized pieces of wood and fiber bundles as well as other undesired substances. The screen can also fractionate fibers according to their length for improving the properties of the pulp. The precise function of the screen is dependent on the location in the process where it is used. In the screening process the water suspension of the pulp fibers is typically pumped into a cylindrical chamber, wherein the suspension is brought to contact with the screen surface and a rotor moving at high velocity. The rotational velocity of the rotor pushes the fibrous material into movement, whereby part of it is passed as accept through apertures in the screen surface. The high-speed rotor applies positive and negative impact pulses to the suspension. The positive impact pulses push the fibers through the apertures in the screen and may fractionate the fibers. The negative impact pulses provide for a regular flush-back of the apertures in the screen surface so that the fibers do not plug the apertures.

The pulp suspension consists of millions of elastic fibers that easily attach to each other forming so-called fiber flocks. Even at a low consistency such as 0.01% the fibers form unstable flocs. In a typical screening consistency, 1-3% the fibers form stable flocks and fiber networks hamper the screening. The fibers and undesired solid matter are periodically removed from the net in order to enable the screening the remaining fibers from the flocks and fiber networks into reject and accept fibers. When the pulp consistency increases, the force required for decomposing the fiber network increases intensively and finally a process limit is reached, where the apertures in the screen surface or the reject line is clogged. A large number of various rotor solutions has been developed with the aim of ensuring a continuous screening operation.

In principle, the rotors can be divided into two basic groups, open and closed rotors. Both are being used and their purpose is, as known, to keep the screening surface clean, i.e. to prevent the formation of a fiber mat on the screening surface. The first group is characterized in that the interior of the screen drum is provided with a rotary shaft or a rotor, whereto blades are attached by means of arms. An example of this kind is the rotor solution according to U.S. Pat. No. 4,193,865, where the rotor is arranged rotatably inside a cylindrical stationary screen drum, said rotor comprising blades located in the vicinity of the screen drum surface, which blades in the construction according to said patent form an angle with the drum axis i.e. the blades extend obliquely from one end of the screen drum to another. When moving, the blades impact pressure pulses on the screen surface, which pulses open the surface apertures. There are also solutions, in which the blades have been located on both sides of the screen drum. In that case, the suspension to be treated is fed to the inside or to the outside of the drum and the accept is, respectively, discharged from the outside or inside of the drum.

In stationary rotors the rotor is an essentially closed cylindrical piece, the surface of which is provided with pulsation members, for instance almost hemispherical protrusions, so-called bulges. In this kind of an apparatus the pulp is fed into a treatment space located between the rotor cylinder and the screen drum outside thereof, whereby the purpose of the rotor protrusions, e.g., the bulges, is both to press the pulp against the screen drum and by means of its trailing edge to withdraw the fiber mat off the screen drum apertures. The bulges can be replaced by other kinds of protrusions.

A solution widely used in the market is a represented by a method according to FI patent 77279 (U.S. Pat. No. 5,000,842) and the solution developed for the implementation thereof. The method according to said patent is characterized in that the fiber suspension is subjected to axial forces with varying intensity and effective direction, the direction and intensity of which are determined based on the mutual axial positioning of the point of application and the countersurface of the screen drum and by means of which the axial velocity profile of the fiber suspension is changed while maintaining the flow direction continuously towards the discharge end. Preferably the surface of the rotor is divided into four zones: feed, feed and mixing, mixing, and efficient mixing. The rotor surface is typically provided with 10-40 protrusions, the shape of which varies according to the zone i.e. the axial part of the rotor that they are located on. The protrusions on the housing surface of the rotor are mainly formed of front surfaces facing the flow, preferably surfaces parallel to the housing surface and back surfaces that descend towards the housing surface of the rotor. The housing surface of the rotor is provided with protrusions of several different forms, which have been arranged onto the rotor housing so that two or more circumferential zones are formed separated from each other in the axial direction of the rotor, such as e.g. 4 zones. At least part of the front surfaces of the protrusions forms an angle with the axial direction. The front surface of the protrusions can be divided into two parts that form with the axial direction angles of different size. The variation interval of the angles is −45°-+45° compared to the axial direction. However, the functioning principle of the protrusions is the same as in other corresponding devices. The abrupt front surface imparts a strong pressure shock to the fiber mat on the screen drum, whereby the accept is pressed through the apertures of the drum. The sloping back surface of the protrusion withdraws some water back to the screening zone and thus releases from the grooves and apertures major particles and fiber flocks thus cleaning the screen drum.

U.S. Pat. No. 5,192,438 describes a rotor which provides high intensity axial shear stress in addition to high positive pulses and negative pulses. The rotor has a contoured surface including a plurality of protrusions. A protrusion has a front plane, an upper plane, an inclined plane and edge surfaces, which may converge. The trailing surface of the protrusion is abrupt.

So, in prior known solutions the functional prerequisite of pressure screens starts from the presumption that the rotor element is to develop an adequate pressure impulse on the interface to make the fiber particles flow through the screening surface and that the rotor element is to create by its trailing edge a negative pressure impulse to generate a turbulence that cleans the apertures clogged by the previous positive impulse. It has also been generally presented in the field that a negative impulse withdraws liquid back towards the feeding space preventing excess thickening of the fiber suspension in the feeding space and in its part cleaning the apertures of the screening surface. For enabling to create these conditions, the rotor must have an adequate rotational speed, which is, however, limited by energy consumption and mechanical durability of the screen, a typical speed for a rotor described in FI-patent 77279 (U.S. Pat. No. 5,000,842) is 24 m/s.

In the present industrially used pressure screen applications the rotor solutions have enabled to reach the maximum feed consistency level of pulp. The consistency level is almost the same for different rotor types, for instance for softwood (SW)-pulp approximately 2-3%. Thus, there is a need in the field to develop a screen rotor that will allow higher feed consistencies.

SUMMARY OF THE INVENTION

A screen, especially a pressure screen, has been developed having a rotor element construction such that thicker pulp than before can be treated and thus essentially increase the feed consistency of the pulp compared to known solutions.

The screen apparatus, in one embodiment, comprises a housing, conduits therein at least for the fiber suspension being fed in, for reject and accept, as well as a rotor and a cylindrical screen drum installed in the housing, at least one of which is rotatable, whereby the rotor surface is provided with rotor elements that are in proximity to the screen drum surface, whereby a rotor element mainly comprises a front surface facing the flow, an upper surface and a descending trailing surface. The trailing surface of the rotor element may be curved and the sidewalls thereof converge at least along a part of their length towards the back point of the element. The length of the element, i.e. the distance between the front surface and the back point, is essentially greater than the greatest width of the element, i.e., the distance between the sidewalls.

The sidewalls of the trailing surface converge towards the back point such that the opposite sidewalls converge at the back point or substantially converge such that the back point is a narrow back section that may be curved.

According to one embodiment in a screening device, a rotor element is on a rotor coaxial with a cylindrical screen drum, wherein a gap between the rotor and screen drum receives a pulp flow and at least one of the rotor and screen drum rotates relative to the other, wherein the rotor element protrudes radially outward from a surface of the rotor and towards the screen drum, the rotor element comprising:

an upper surface and a front face between the surface of the rotor and the upper surface, wherein the front face faces a circumferential movement of the pulp-flow in the gap;

a trailing surface extending downstream of the pulp flow from the upper surface and the trailing surface tapers to the surface of the rotor and meets the surface at a back point of the trailing surface, and opposite sidewalls of the trailing surface gradually converging at the back point.

The trailing surface of the rotor element allows the pulp to flow without stalling, as smoothly as possible and without causing a strong turbulence on the screening surface. In the rotor elements disclosed herein, a positive pulse is first created, but after that by the design of the trailing surface of the rotor element a situation is generated where the trailing surface releases the pulp fibers as calmly as possible, minimizing turbulence on the screening surface. In the rotational direction of the rotor, the pulp first contacts the front surface of the rotor element, which guides the pulp to a capacity zone where the flow-through of the pulp is generated. The capacity zone is formed by a zone in the vicinity of the surface of the screen basket, where fibers enter the accept side. The front surface can be planar. It can be perpendicular or inclined in relation to the rotor surface. The front surface can be formed of two pieces positioned symmetrically or asymmetrically in relation to the longitudinal center axis of the element forming a wedge to receive the flow. The front surface of the rotor element can also be curved. The front end, i.e. the front surface of the rotor element, the upper surface or plane parallel to the rotor surface and optionally a shoulder are designed so that the pulp is led as an essentially smooth film into the space between the screening surface and the rotor element, wherefrom the accepted pulp fibers are run and pressed through the screening surface into the accept side. According to an embodiment, the rotor element can also be devoid of a shoulder, such that the pulp may as well contact directly a front surface and a trailing surface that curves therefrom towards the back point. A rotor element's planar upper surface devoid of a shoulder can have an advantageous influence on energy consumption.

The trailing surface of the rotor element is curved and the sidewalls thereof converge at least along a part of their length towards and at the back point of the element. According to an embodiment, the trailing surface has at least a first part and a second part, whereby the first part is closest to the front surface or the possible shoulder and its sidewalls are substantially parallel to each other, i.e. the width does not change, while the sidewalls of the second part converge towards and to the back point. According to another embodiment, the sidewalls of the trailing surface converge towards and to the back point essentially starting from the shoulder.

In the initial point of the curved trailing surface of the rotor element a lag angle is preferably less than 10°, whereby the angle is formed between a tangential plane intersecting said initial point of the of the trailing surface curve and a tangential plane of a curvature radius of the trailing surface curve.

According to an embodiment the front part and/or back part of a novel rotor element can also be hydrofoil-like. One end of the rotor element is a stationary piece, whereby the element can e.g. be constructed as a stationary piece, but the front portion's part facing the rotor body has been cut away. That way, the front part's surface receiving the pulp flow is hydrofoil-like and guides the pulp smoothly. Preferably, the front edge of the hydrofoil-like front portion is curved.

The rotor elements disclosed herein allow the fiber suspension to be led as a film-like flow into the narrow space between the element and the screening surface, in which space the fiber suspension is pressed through the apertures in the screen surface. The gently curved trailing surface the sidewalls of which converge towards the back point guides the flow towards the back point and minimizes stalling of the flow, increase of flow resistance caused by cavitation, and decreases turbulence that prevents water from being removed to the accept side and the reject from thickening. Thus, the escape of small impurities and first of all water into accept is prevented, as the retention capacity of the fiber net is improved due to calm flow conditions. Thus, the thickening of the reject is decreased compared to known screens.

The design of rotor element disclosed herein is hydrodynamically efficient, and it allows a greater rotational speed without remarkable increase in energy. Simultaneously, the mechanical stress of the device is decreased. The rotor having the elements according to the invention operates at low circumferential speeds as well, which results in remarkable saving in energy.

The rotor elements disclosed herein may be applied in connection with a closed rotor, most usually having a cylindrical shape, but it can also be e.g. conical. The rotor can also be open, whereby the rotor elements are supported by arms or other supporting members.

SUMMARY OF DRAWINGS

The present invention is described in more detail with reference to the appended figures, in which.

DETAILED DESCRIPTION OF THE INVENTION

Figure 1A:
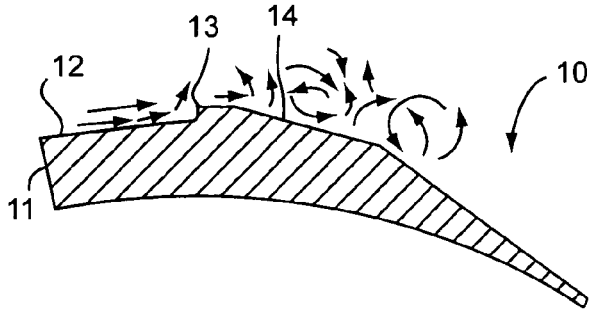
FIG. 1a PRIOR ART
FIGS. 1*a*, 1*b*, 1*c* and 1*d* illustrate schematically the flow conditions surrounding a known rotor element (FIGS. 1*a* and 1*b*) and an embodiment of novel rotor element according (FIGS. 1*c* and 1*d*)
Figure 1B:
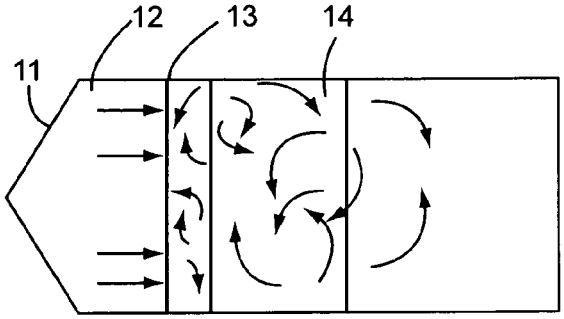
FIG. 1b PRIOR ART

FIGS. 1*a* and 1*b* illustrate a conventional rotor element 10 in side view and as seen from above, respectively. The rotor element has a front surface 11, a plane surface 12 parallel to the rotor surface, a shoulder 13 and a trailing surface 14 descending angularly towards the rotor surface. The front surface 11 is perpendicular towards the rotor surface and divided into two parts, which together form a plow-like surface. The abrupt front surface imparts a pressure shock to the pulp flow in the screen drum, by means of which the accept is pressed through the screen drum. After the shoulder, an intensive turbulence starts in the pulp flow under the effect of the suction impulse resulting as the taper of the trailing edge causes the surface of the rotor element to move radially away from the screen. The turbulence keeps the screen surface open and thus allows water to flow into the accept, contributing to thickening of the reject.

Figure 1C:
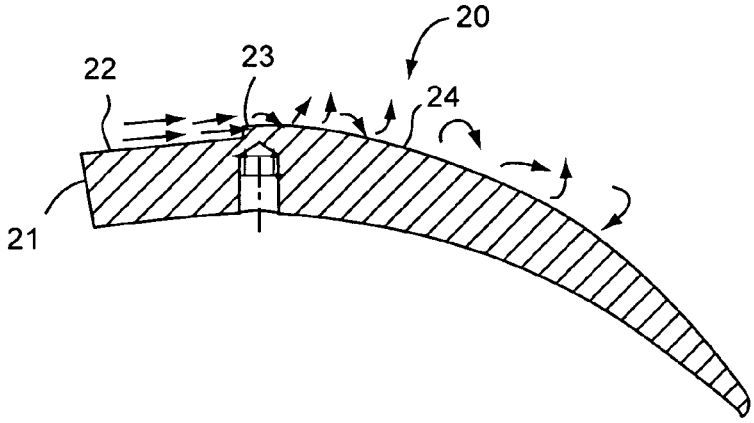
Figure 1D:
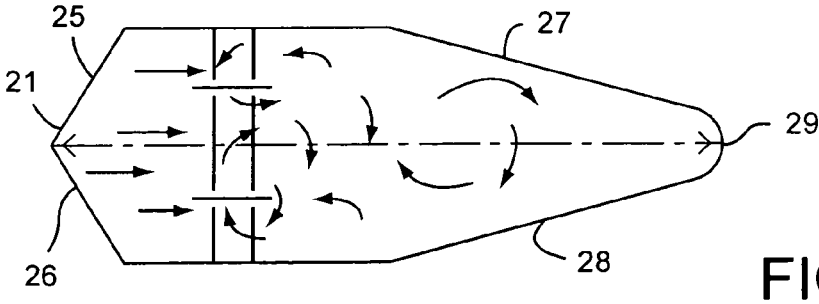

FIGS. 1*c* and 1*d* illustrate a novel rotor element 20 on the surface of a cylindrical rotor. The element has a front surface 21, an upper plane 22 parallel to the rotor surface, a shoulder 23 and a trailing surface 24 descending curvedly towards the rotor surface. The sidewalls 27 and 28 of the trailing surface converge towards and at the back point 29. The front surface 21 of the rotor element 20 is perpendicular towards the rotor surface and divided into two parts 25 and 26, which together form a plow-like front surface 21. The front surface and the upper plane 22 assist in guiding the pulp as a thin smooth film onto the screening surface, from where the accepted fiber fraction is passed to the accept side of the screen drum in a zone where the clearance between the screen drum and the rotor element is the smallest. After the shoulder the curved trailing surface 24 has a long gentle slope which minimizes the turbulence of the pulp flow to promote a homogeneous pulp flow that conforms to the curvature of the screening surface. The homogeneous pulp flow reduces the amount of water entering the accept side and thus minimizes the thickening disturbing the screening of the reject.

Figures 2A, 2B, 2C, 2D:
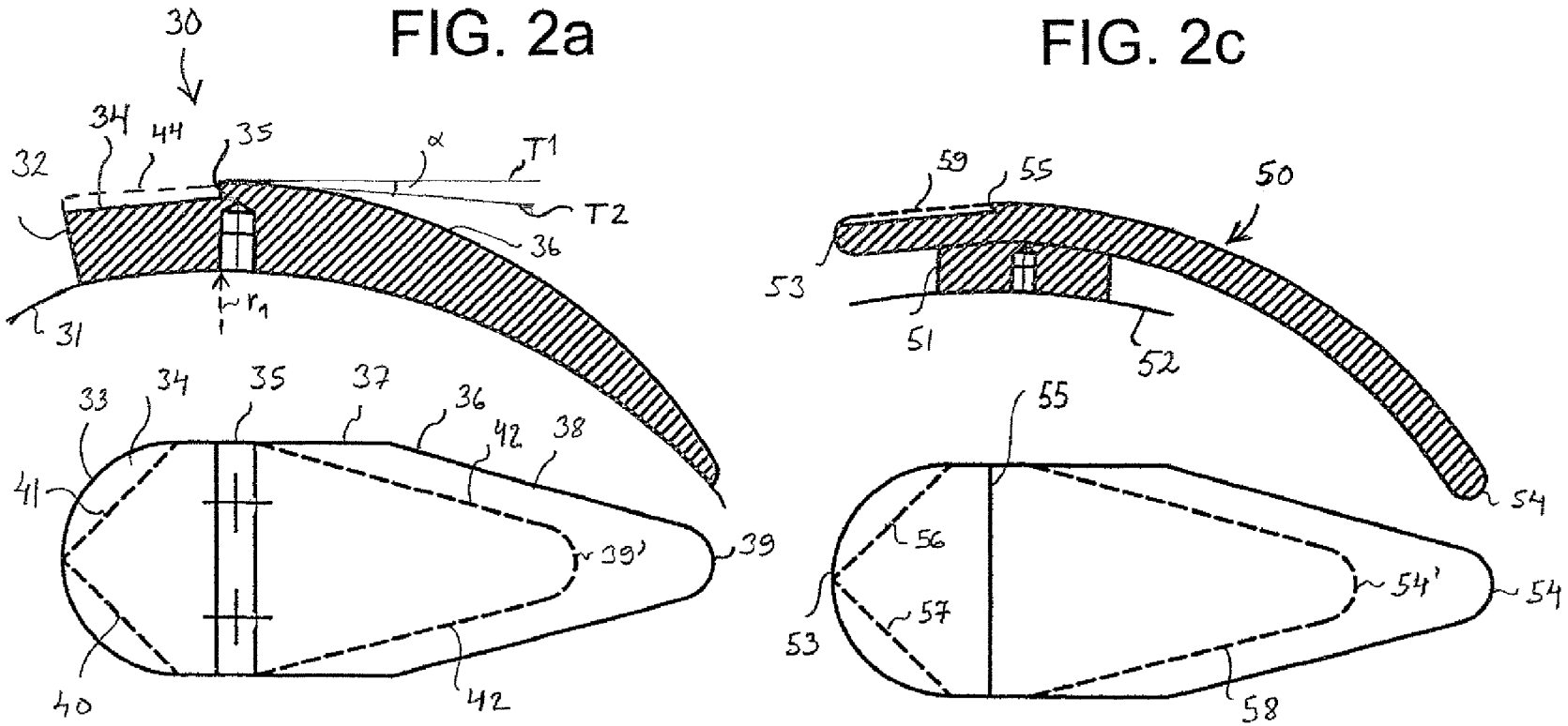
FIGS. 2*a* to 2*d* illustrate preferred embodiments of the rotor element.

FIGS. 2*a* to 2*d* illustrate schematically preferred forms of a novel rotor element, both in side view (FIGS. 2*a* and 2*c*) and from above (FIGS. 2*b* and 2*d*). FIG. 2*a* shows a rotor element 30 in the form of a protrusion on the surface 31 of the rotor, which protrusion can be formed on said surface or the element is attached to the surface by appropriate means known per se, such as by welding, with a screw and other attachment means. The views from above (FIG. 2*b* and 2*d*) each show two different embodiments of the novel rotor element. The first rotor element embodiment is shown by a continuous line in FIGS. 2*b* and 2*d*, the front surface 32 is perpendicular in relation to the rotor surface, but the front edge 33 is curved, so that the energy consumption is decreased. After the front surface follows a plane 34 parallel to the rotor surface, which plane ends in a shoulder 35. The trailing surface 36 is curved to promote laminar and smooth pulp flow between the screen and trailing surface and downstream of the shoulder. In this embodiment (continuous lines in FIGS. 2*b* and 2*d*), the trailing surface has at least a first part 37 and a second part 38, whereby the first part is closest to the shoulder and its sidewalls are substantially parallel to each other, while the sidewalls of the second part converge towards the back point 39,' 54, such that the opposite sidewalls converge at the back point or substantially converge such that the back point is a narrow back section that may be curved.

In the initial point of the curved trailing sidewalls of the rotor element the lag angle is preferably less than 10°, whereby an angle $\alpha$ is formed between a tangential plane T2 intersecting said initial point of the curve and a tangential plane T1 of the radius of curvature r1.

Another embodiment of the novel rotor element is shown by the dash lines in FIGS. 2*b* and 2*d*. In this another embodiment, the front surface of the rotor element is divided into two parts 40 and 41 or 56 and 57 (dash line), which together form a plow-like surface. Then the front edge has a wedge-like form. The sidewalls 42 or 58 of the trailing surface converge towards and to one of the back points 39, 39', 54 and 54' essentially as early as starting from the shoulder 35 or 55. A trailing surface converging starting from the shoulder can also be arranged in connection with a curved front surface or a wedge-like front surface, or a two-part trailing surface described in connection with the first embodiment can be arranged in connection to a wedge-like front surface.

According to an embodiment the rotor element can also be devoid of a shoulder, i.e. the pulp may as well contact directly a front surface and a trailing surface that curves therefrom towards the back point. This alternative is illustrated with dash lines 44 or 59 on the rotor's upper surface in FIGS. 2*a* and 2*b*. A rotor element's planar upper surface devoid of a shoulder can have an advantageous influence on energy consumption.

FIGS. 2*c* and 2*d* show a rotor element 50 is attached to surface 52 of the rotor via a support member 51. The rotor element 50 is similar to the rotor element 30 illustrated in FIGS. 2*a* and 2*b*, except the front surface 53 is curved, as shown in the side view of FIG. 2*c* and the element is supported by a post 51 on the rotor surface 52.

Figure 3:
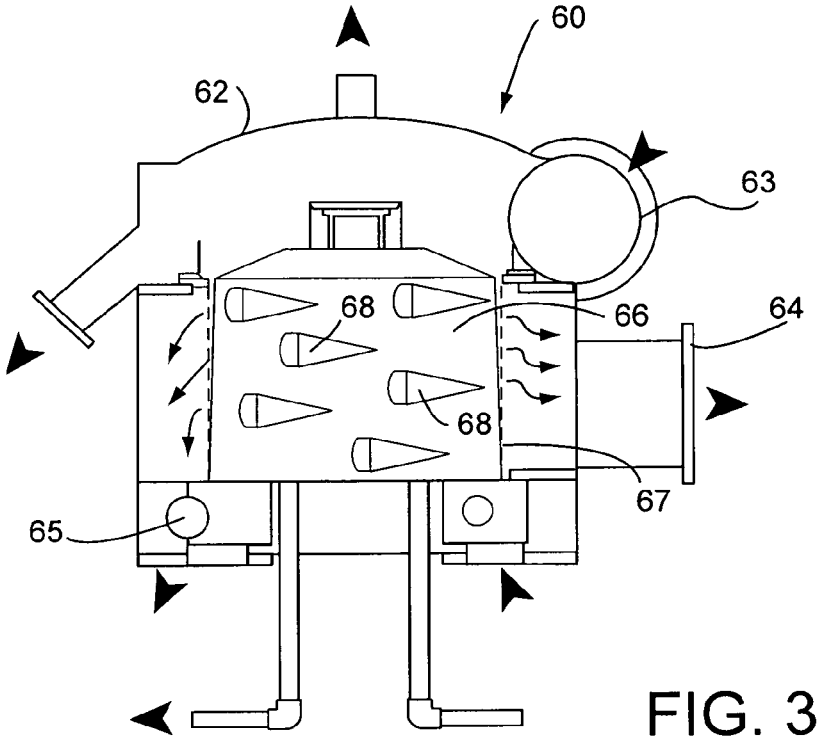
FIG. 3 illustrates a schematic cross section of a screen.

In accordance with FIG. 3, a screen device 60 comprises an outer housing 62, conduit 63 therein for incoming pulp and discharge conduits for accept 64 and reject 65, a stationary screen drum 67 and an essentially cylindrical rotor 66 therein. The screen drum 67 can in principle be of any type, but the best results are obtained if a profiled screen drum is used. The operation of the screen device 60 is essentially the following: the fiber suspension is fed via conduit 63 inside the device, wherein the fiber suspension is passed into the gap between the screen drum 67 and rotor 66. The accept flown through the apertures of the screen drum is discharged from conduit 64, and the pulp flown to the lower end of the gap between the screen drum 67 and rotor 66 and thereout is discharged from reject conduit 65.

Further, FIG. 3 shows that the surface of rotor 66 on the side of the screen drum 67 is provided with rotor elements 68 in the form of protrusions on the rotor surface. The rotor elements each have curved trailing surface with sidewalls that converge at a back point.

Figure 4A:
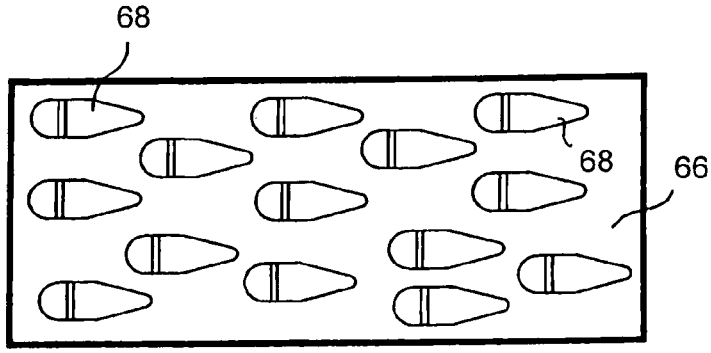
FIGS. 4*a* and 4*b* illustrate a top view of a plurality of rotor elements arranged on a surface of the rotor, where the rotor is shown in planar form for illustrative purposes.
Figure 4B:
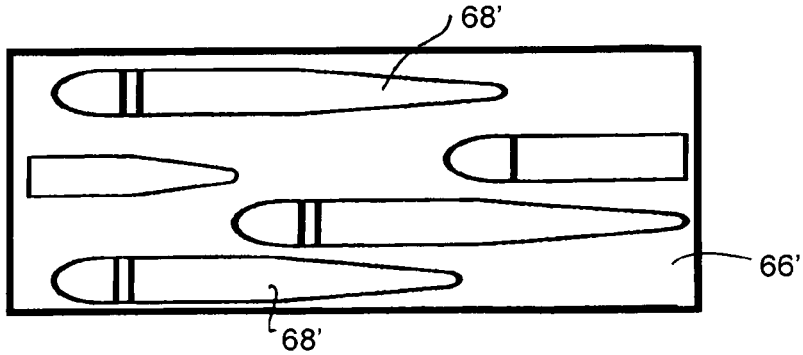

FIG. 4*a* and 4*b* illustrates rotor elements 68, 68' arranged on the surface of a rotor 66 bent, whereby the rotor surface is shown in planar form for purposes of illustration. The novel rotor element 68 (such as shown in FIGS. 1*c* and 1*d*, and FIG. 2*a* to 2*d* and 5*a* to 5*f*) allows using a greater number of rotor elements 68 on one and the same circumferential sector without decreasing the goodness criteria of screening. Additional screening capacity can be obtained by locating more rotor elements on the same circumferential line around the rotor. Adding rotor elements may increase the feeding consistency. In contrast, conventional rotor elements cause strong cavitations and flow stall in the pulp flow over and after the trailing surfaces. The cavitations and stalling results in turbulence in the pulp flow that interferes with pulp flow over downstream rotor elements. The cavitation and stalling of the pulp flow, limits the number of conventional rotor elements that can be positioned on the same circumferential line around a rotor while providing effective screening.

FIG. 4*b* illustrates a rotor element 68' embodiment (the lower drawing), in which the novel rotor element is elongated in the circumferential direction. The arcuate length of the elongated element can be at least 35°, even 50°-200°. The number of elements on the same circumferential segment can be e.g. two.

Figure 5A:
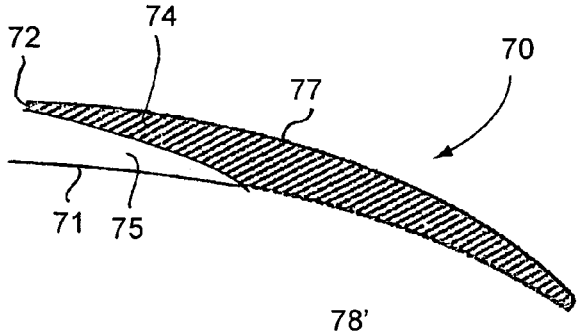
FIGS. 5*a* to 5*f* illustrate preferred embodiments of the novel rotor element.
Figure 5B:
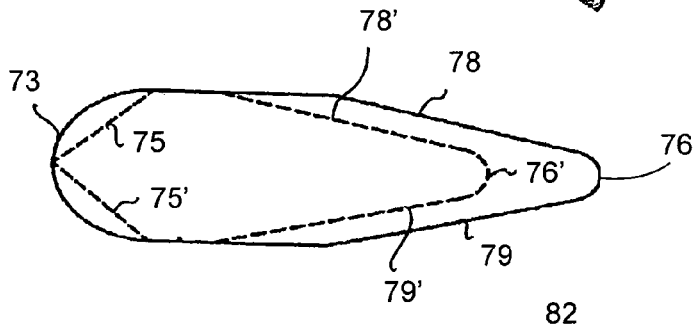
Figure 5C:
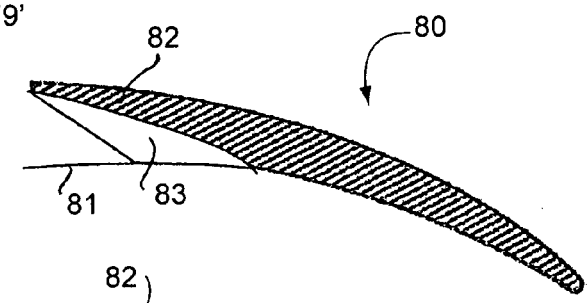
Figure 5D:
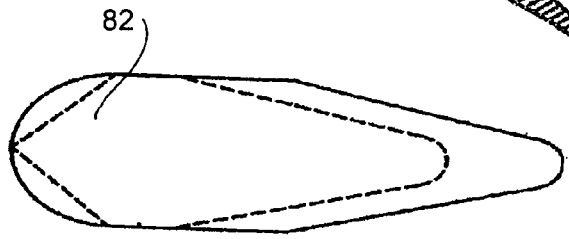
Figure 5E:
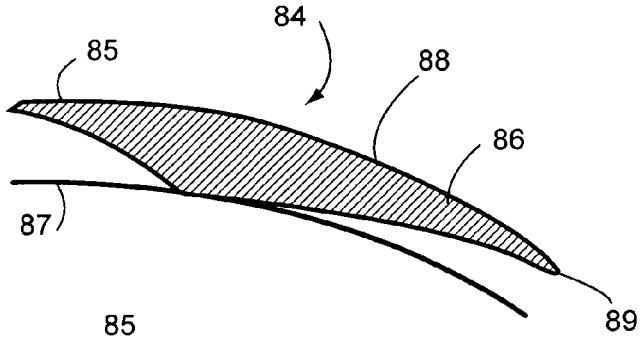
Figure 5F:
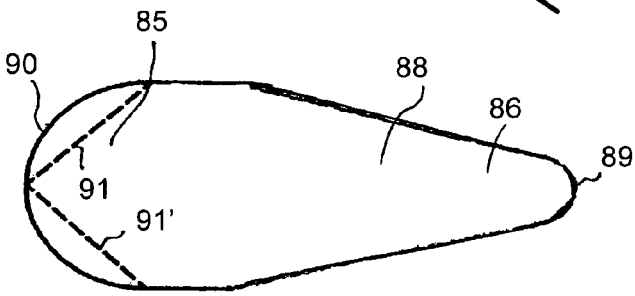

FIGS. 5*a*-5*f* show additional embodiments of a rotor element according to the invention in a way similar to that in connection with FIGS. 2*a*-2*d*, as well as in side view (FIGS. 5*a*, 5*c* and 5*e*) and from above (FIGS. 5*b*, 5*d* and 5*f*).

In FIGS. 5*a* and 5*b*, a rotor element 70 is on the surface 71 of the rotor in form of a protrusion that can be formed in the said surface, or the element is fixed onto the surface by means known per se, such as by welding, with a screw etc. However, the front part 74 of the rotor element is clear of the rotor surface, so that there is a gap 75 between the rotor element and the rotor surface and that the front part is similar to a hydrofoil. Thus the pulp flow can pass it smoothly, i.e. without a major pressure shock. At the same time, the rotor element penetrates the pulp flow smoothly, whereby the flow is distributed more evenly to the capacity zone. This facilitates a smooth and efficient flow of the pulp onto the rotor element. The view from above (FIG. 5*b*) illustrates two different embodiments. In the first embodiment (continuous line) the front edge 73 of the front surface 72 is curved. In the other embodiment the front surface is divided into two parts 75 and 75' (dash line) that together form a wedge-like surface. Thus the front surface has a wedge-like shape. In accordance with the invention the trailing surface 77 is curved and its sidewalls 78 and 79 or 78' and 79' converge towards the back point 76 or 76', respectively.

FIGS. 5*c* and 5*d* illustrate an alternative shape of a front part 82 of rotor element 80 on the rotor surface 81. The rotor element is machined or gouged at the sides 83 of the front part 82 so that the flow is smoothly directed under the front part to the sides of the element. The purpose is to pierce the pulp flow with the rotor element so that a smooth flow onto the element is achieved. Otherwise the shape of the rotor element is similar to that of FIGS. 5*a*-5*b*.

FIGS. 5*e* and 5*f* illustrate on alternative embodiment, wherein both the front part 85 and the back part 86 of the rotor element 84 are machined or gouged so that they are clear of the rotor surface 87. The trailing surface 88 of the element is curved and its sidewalls converge towards the back point 89. The view from above (FIG. 5*f*) illustrates two different embodiments, in which the front edge 90 (continuous line) of the front surface is curved or the front surface is divided into two parts 91 and 91' (dash line) that together form a wedge-like surface.

Figure 6:
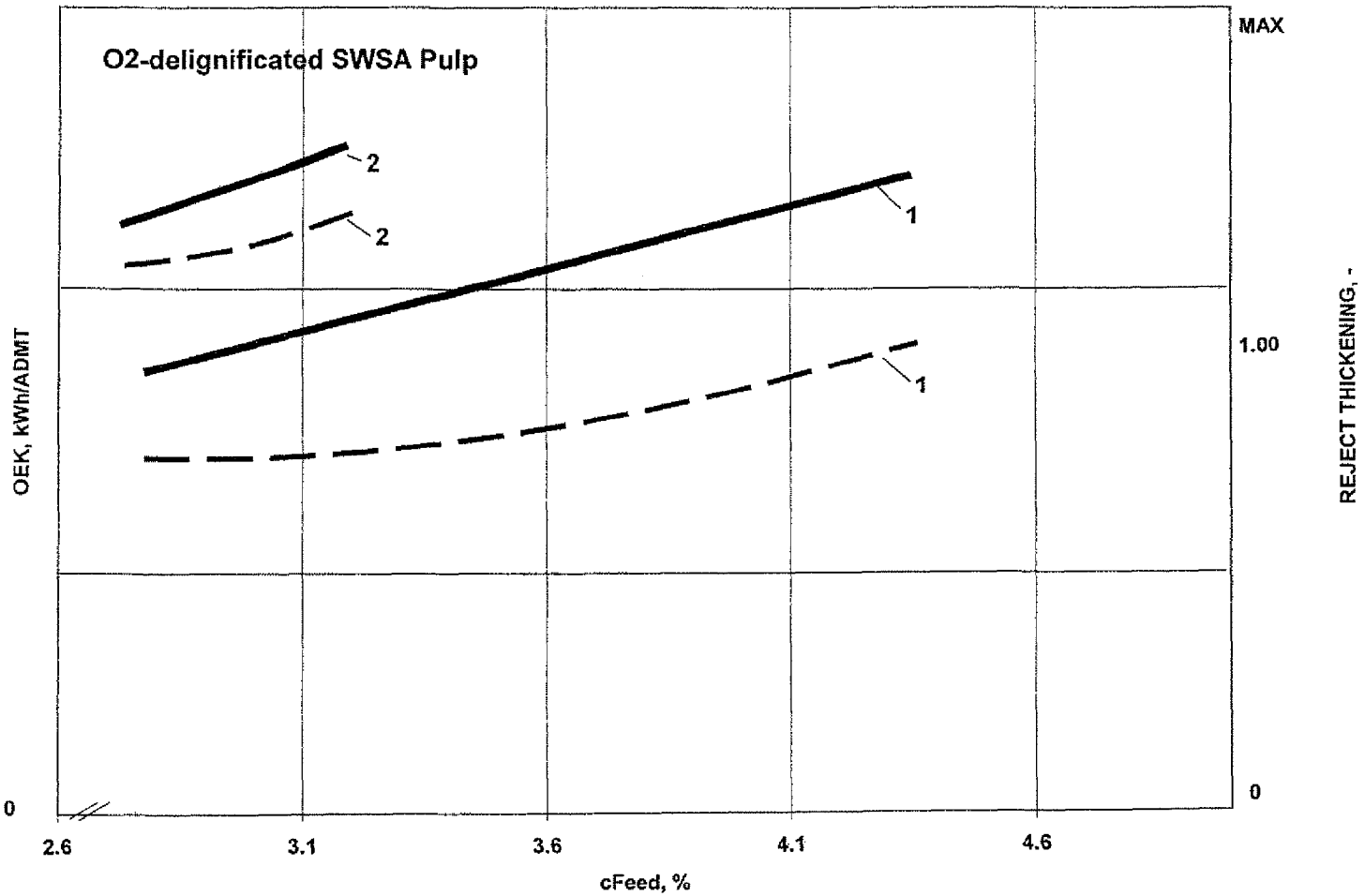
FIG. 6 is a graph that illustrates the capacity of a screen device having a rotor with the novel rotor elements as disclosed herein and that of a prior art screen device having a rotor with conventional rotor elements, such as shown in FIGS. 1*a* and 1*b*.

FIG. 6 illustrates the maximum functional capability of a screen having the novel rotor elements disclosed herein and a prior art screen in a pulp production line with normal equipment. The dash line illustrates the consistency of the reject as a function of feeding consistency, and the continuous line the specific energy consumption (OEK) of the rotor as a function of feeding consistency. The pulp in question is oxygen-delignified SWSA (softwood sulphate) pulp. Lines 1 illustrate a screen with the novel rotor elements and lines 2 a prior art screen. The device with the novel rotor elements operates at a significantly higher feeding consistency than the prior art device, and still the energy consumption is lower. Also, the thickening of the reject is lower in the device with the novel rotor elements, although it is operated at the same or a higher feeding consistency as the device with the prior art screen. The device with the novel rotor elements is further characterized in that lower rotor speeds can be used at the required feeding consistency, which decreases energy consumption.

The screen with novel rotor elements disclosed herein may provide at least the following advantages:

A. low thickening tendency of the reject.

B. high feeding consistencies can be used, e.g. in the apparatus disclosed herein had a feeding consistency of SW-pulp of 1.5% higher than the prior art device. As a result of this, the number of water cycles in the mill is decreased, need for pumping is decreased, apparatuses, such as containers, are required in decreased numbers, sizes of the apparatuses are decreased, pipe lines become shorter, the overall space requirement is decreased.

C. decreased energy consumption compared to prior art.

D. better running security of the screen, because cavitation is decreased, and

E. more reserve capacity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An apparatus for screening a fibrous suspension comprising:

a housing having conduits for receiving a fiber suspension and for discharging of rejects and accepts;

a rotor and a cylindrical screen drum concentrically mounted in the housing, wherein at least one of which the rotor and cylindrical screen rotates, a surface of the rotor includes rotor elements in proximity to the surface of the screen drum, whereby the rotor elements each include a front surface facing a flow of the fiber suspension between the rotor and screen drum, an upper surface proximate to the screen drum, and a trailing surface sloping from the upper surface towards the surface of the rotor, wherein the trailing surface of the rotor element has sidewalls which converge towards each other and towards a back point of the rotor element.

2. The apparatus according to claim 1, wherein the sidewalls of the trailing surface converge symmetrically in relation to a longitudinal center axis of the rotor element.

3. The apparatus according to claim 1 wherein the trailing surface comprises at least a first part and a second part, whereby the sidewalls of the first part are parallel to each other and the sidewalls of the second part converge at the back point.

4. An apparatus for screening a fibrous suspension comprising:

a housing having conduits for receiving a fiber suspension and for discharging of rejects and accepts;

a rotor and a cylindrical screen drum concentrically mounted in the housing, wherein at least one of which the rotor and cylindrical screen rotates, a surface of the rotor includes rotor elements in proximity to the surface of the screen drum, whereby the rotor elements each include a front surface facing a flow of the fiber suspension between the rotor and screen drum, an upper surface proximate to the screen drum, wherein the upper surface includes a shoulder forming a step on the upper surface, and a trailing surface of each of the rotor elements slopes from the upper surface towards the surface of the rotor, wherein the trailing surface of the rotor element has sidewalls which converge towards a back point of the rotor element.

5. The apparatus according to claim 4 wherein the sidewalls of the trailing surface converge starting from the shoulder.

6. The apparatus according to claim 1 wherein the front surface of the rotor element is planar and formed of front surface sections arranged symmetrically in relation to a longitudinal axis of the rotor element and the front surface sections form a wedge facing the flow.

7. The apparatus according to claim 1 wherein the front surface of the rotor element includes planar sections and the planar sections are arranged asymmetrically relative to a longitudinal center axis of the element forming a wedge for receiving the flow.

8. The apparatus according to claim 1 wherein the front surface is curved.

9. The device according to claim 1 wherein the upper surface is parallel to the surface of the rotor.

10. The apparatus according to claim 1 wherein the rotor is cylindrical and each of the rotor elements is a protrusion from the rotor surface.

11. The apparatus according to claim 1, wherein each of the rotor elements is formed as a protrusion from the rotor surface, wherein the rotor elements extend radially outward of the rotor surface.

12. The apparatus according to claim 1, wherein each of the rotor elements include a protrusion from the rotor surface, wherein the front surface forms a hydrofoil shape.

13. The apparatus according to claim 1, wherein each of the rotor elements are formed as a protrusion from the rotor surface and the trailing surface is formed by machining or gouging the protrusion.

14. The apparatus according to claim 1 further including a support member for each of the rotor elements to support the rotor element on the surface of the rotor.

15. The apparatus according to claim 1, wherein in an axial direction of the rotor, a plurality of rotor elements are arranged in a staggered pattern in which rotor elements at least partially overlap along the axial direction.

16. The apparatus according to claim 1 wherein the rotor elements are arranged sequentially a uniform distance from each other along a circumferential line around the rotor.

17. An apparatus for screening a fibrous suspension comprising:

a housing having conduits for receiving a fiber suspension and for discharging of rejects and accept;

a rotor and a cylindrical screen drum concentrically mounted in the housing, wherein at least one of which the rotor and cylindrical screen rotates, a surface of the rotor includes rotor elements in proximity to the surface of the screen drum, whereby the rotor elements each include a front surface facing a flow of the fiber suspension between the rotor and screen drum, an upper surface proximate to the screen drum, and a trailing surface sloping from the upper surface towards the surface of the rotor, wherein the trailing surface of the rotor element has sidewalls which converge towards a back point of the rotor element;

wherein each rotor element includes a lag angle ($\alpha$) in an upstream point of the curved trailing surface which is less than 10 degrees, whereby the lag angle ($\alpha$) is formed between a tangential plane (T2) intersecting said initial point of the trailing surface curve and a tangential plane T1 of a curvature radius r1 of the trailing surface curve.

* * * * *